US005177810A

United States Patent [19]

Minton et al.

[11] Patent Number: 5,177,810

[45] Date of Patent: Jan. 12, 1993

[54] DETACHABLE SUN SHIELD

[75] Inventors: David M. Minton; Barbara B. Minton, both of Simonton, Tex.

[73] Assignees: David Minton; Barbara Minton, both of Simonton, Tex.

[21] Appl. No.: 701,708

[22] Filed: May 17, 1991

[51] Int. Cl.[5] ..... A42B 1/06

[52] U.S. Cl. ..... 2/10; 2/185 R; 2/199; 2/425

[58] Field of Search ..... 2/9, 10, 15, 171, 172, 2/195, 185 R, 199, 425

[56] References Cited

U.S. PATENT DOCUMENTS

| | | | |
|---|---|---|---|
| 630,707 | 8/1899 | Jacobson | 2/10 |
| 1,199,650 | 9/1916 | Aman | 2/10 |
| 1,209,284 | 12/1916 | Gazan | 2/10 |
| 1,232,812 | 7/1917 | Kirchner | 2/10 |
| 1,232,992 | 7/1917 | Stering | 2/10 |
| 1,282,723 | 10/1918 | Altman | 2/10 |
| 1,543,094 | 6/1925 | Blecker et al. | 2/199 X |
| 1,545,706 | 7/1925 | Steingold | 2/172 |
| 1,829,538 | 10/1931 | Prichard | 2/10 |
| 1,883,756 | 10/1932 | Bloom | 2/172 |
| 2,179,719 | 11/1939 | Goskey | 2/10 |
| 2,248,331 | 7/1941 | Blodjer | 2/10 |
| 2,269,322 | 1/1942 | Serr | 2/10 |
| 2,538,608 | 1/1951 | Vaca | 2/10 OR |
| 3,685,054 | 8/1972 | Raschke | 2/10 |
| 4,063,740 | 12/1977 | Mader | 2/185 R X |
| 4,210,972 | 7/1980 | Baclit | 2/10 |
| 4,485,495 | 12/1984 | Lunt | 2/195 X |
| 4,644,588 | 2/1987 | Zawacki | 2/15 X |
| 4,811,430 | 3/1989 | Janusz | 2/171 X |
| 4,850,049 | 7/1989 | Landis et al. | 2/9 |
| 4,873,726 | 10/1989 | Tapia | 2/195 |
| 5,067,174 | 11/1991 | Ritchey et al. | 2/9 X |

FOREIGN PATENT DOCUMENTS

| | | | |
|---|---|---|---|
| 1477818 | 12/1975 | United Kingdom | 2/199 |

*Primary Examiner*—Werner H. Schroeder
*Assistant Examiner*—Jeanette E. Chapman

[57] ABSTRACT

A sun shield for infants including a cap, a transparent shield, and a binding material. The cap has a strap extending downwardly therefrom and positioned in a location beyond an edge of the transparent shield. The flexible transparent shield is removably affixed to a surface of the cap and extends downwardly below an edge of the cap. The transparent shield is of a material suitable for blocking ultraviolet radiation. The transparent shield has a convexed center extending outwardly from the cap. The binding material is fastened to the transparent shield so as to cover the outer peripheral edge. The transparent shield is fastened along the inner edge of the cap by engaging corresponding sections of hook-and-loop material on the cap and the transparent shield.

5 Claims, 2 Drawing Sheets

DETACHABLE SUN SHIELD

BACKGROUND OF THE INVENTION

1. Field of the Invention

The present invention relates to eyeshields or caps which are worn primarily to reduce the intensity of the sun. Specifically, the present invention relates to a detachable sun shield which may be attached to virtually any cap.

2. Discussion of the Prior Art

Apparatus' which may be worn on the head which include some means of diverting the sun from directly into the eyes have been known or used for years; some are described below.

U.S. Pat. No. 2,377,645, Peffer discloses an eyeshield or visor which independently attaches to the user.

U.S. Pat. No. 4,023,212, Huffman discloses an adjustable visored cap with interchangeable crown that may be adjusted to fit the wearer.

U.S. Pat. No. 4,873,726, Tapia discloses an adjustable cap including a crown portion and interchangeable visor portion.

The aforementioned prior art references are not designed to overcome the specific accomplishments of the present invention.

The most important and specific issue addressed by the present invention is eye protection for babies and small children. Babies, in particular, are unable to keep sunglasses on their faces because of uncontrolled movements and because of their unusually small features. Their noses do not have a developed bridge, hence there is nothing to balance the glasses upon. Most visor type caps are not small enough in head circumference to stay on their heads and can easily be pulled or knocked off. Further, the bill of the cap is small and does not provide adequate, if any, protection or blocking from the sun.

The caps presently available for babies or small children provide little or no eye protection. Infant caps usually comprise a cloth-like head covering including ear flaps and tying means. Most infant caps further include a small bill which serves little or no purpose. The infant cap is placed over the infant's head and pulled down so that the ear flaps cover the ears and the tying means is secured under the child's chin.

Babies cry because of bright sunlight beaming in on them while they are in strollers or playing. Extensive studies have been performed which prove we should protect our eyes from UVA and UVB rays.

Studies have proven that many eye diseases are caused by harmful UVA and UVB rays. The pupil of the eye closes in bright light which limits the light that enters the eye. The pupil opens wider when the light is reduced. Even though, with regular sunglasses or shields, the amount of light is reduced, the pupil opens wider which allows harmful UVA and UVB rays to enter.

SUMMARY OF THE PRESENT INVENTION

The present invention is a 100% shatterproof, somewhat rectangular transparent shield apparatus including a convexed center. The shield apparatus is made of proven 100% UVA and UVB blocking, non-toxic material. The shield apparatus further includes binding which surrounds the outer periphery of the shield apparatus to conceal any exposed edges of the shield apparatus.

A strip of hook-and-loop material is adhered along one side of the shield. Another strip of hook-and-loop material is adhered to the underside of an existing infant cap. The hook-and-loop materials are lined up and fitted together to secure the shield to the cap. When the shield is no longer needed or desired, it is removed, leaving one strip of hook-and-loop material on the cap; one on the shield. The shield may be used over and over again.

The shield is of such size that when it is attached to a cap, the front of the shield extends out from the child's head in proximity with the child's eyes, and slants downward enough to give adequate protection from the suns rays.

DETAILED DESCRIPTION OF THE PREFERRED EMBODIMENT

Figure 1:
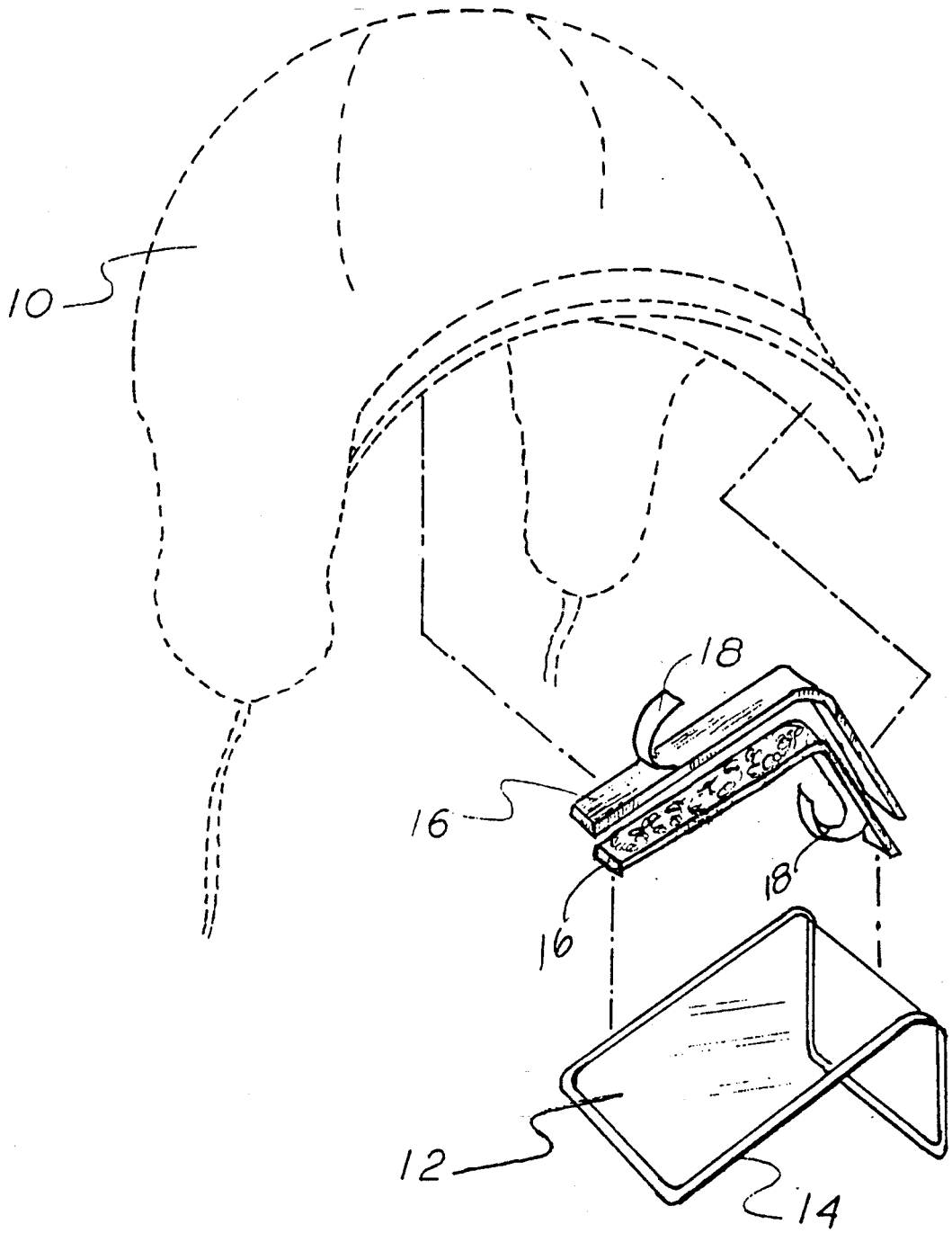
FIG. 1 is an exploded view of the present invention being used in combination with a cap and illustrating the hook-and-loop material.
Figure 2:
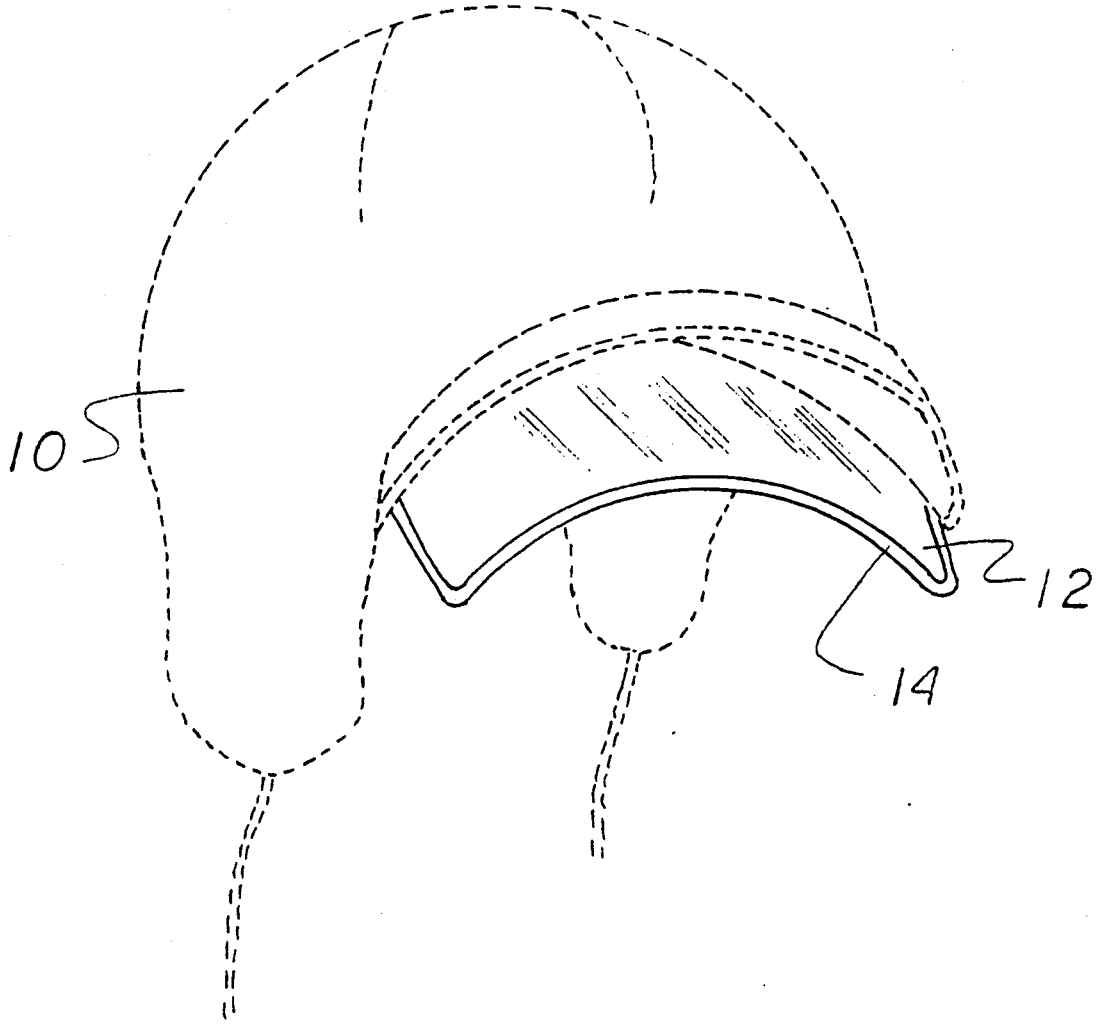
FIG. 2 is a frontal view of the present invention as attached to a cap.

FIG. 1 illustrates an exploded view of the present invention. The shield 12 being somewhat rectangular in shape and convexed slightly in the center to conform to the shape of virtually any cap 10, but particularly, an infant cap. The shield 12 being of 100% shatterproof, transparent, UVA, UVB blocking, non-toxic, rigid, material.

A thin binding 14 or other material surrounds the outer periphery of the shield 12 to conceal and protect the outer edges of the shield 12. This binding 14 may be of a variety of colors and/or patterns which may coordinate with the cap 10.

A strip of adhesive-backed hook-and-loop material 16 is placed parallel along one long side of the shield 12. The adhesive side of the hook-and-loop material is usually covered by a thin strip of paper-like material 18. When this strip of paper 18 is removed, the adhesive is exposed and may be affixed to a surface.

After the paper strip 18 is removed, one strip of hook and loop material 16 may be affixed to an underside of cap 10 and face downwardly therefrom. Another strip of hook and loop material 16 is affixed to an upper surface of shield 12 so as to face upwardly therefrom. As such the strips of hook and loop material 16 can be joined together, in a conventional manner, such that the shield 16 can be fitted to and extend outwardly from the underside of an edge of the cap 10.

As weather conditions allow, the shield 12 may be attached or removed from the cap 10 as desired. When the shield 12 is attached to the cap 10, the cap 10 extends outwardly transverse to the edge of cap 10. The shield 12 is positioned so as to no interfere with the vision of the user.

The foregoing description of the invention has been directed to a particular preferred embodiment of the present invention for purposes of explanation and illustration. It will be apparent to those skilled in the art that modifications and changes to the detachable sun shield may be made without departing from the scope and spirit of the invention. It is, therefore, intended that the following claims cover such modifications and changes.

I claim:

1. A sun shield for infants comprising:

a cap;

a flexible transparent shield removably affixed to a surface of said cap, said flexible transparent shield extending downwardly below an edge of said cap, said transparent shield of a material suitable for blocking ultraviolet radiation, said transparent shield having a convex center extending outwardly from said cap, said transparent shield having a strip of adhesive backed hook-and-loop material fastened along a top surface of said transparent shield, said cap having a strip of adhesive backed hook-and-loop material fastened along a lower edge of said cap, said hook-and-loop material of said cap engaging said hook-and-loop material of said transparent shield, said transparent shield forming a bill of said cap, said flexible transparent shield having an outer peripheral edge; and a binding material fastened to said transparent shield so as to entirely cover said outer peripheral edge.

2. The sun shield of claim 1, said transparent shield comprised of a 100% UVA and UVB blocking non-toxic material.

3. A sun shield comprising:

a cap having a first strip of adhesive backed hook-and-loop material fastened thereto;

a transparent shield of a material suitable for blocking ultraviolet radiation, said transparent shield having a second strip of adhesive backed hook-and-loop material fastened thereto, said first strip engaging said second strip, said transparent shield extending downwardly beyond an edge of said cap, said transparent shield having a convexed center extending outwardly from said cap, said convexed center extending transverse to said edge of said cap, said transparent shield having an outer peripheral edge extending therearound, said second strip of adhesive backed hook-and-loop material fastened to an outer surface of said transparent shield, said first strip of adhesive backed hook-and-loop material fastened along and facing downwardly from an inner edge of said cap; and a binding material fastened to said transparent shield so as to entirely cover said outer peripheral edge.

4. The sun shield of claim 3, said transparent shield comprised of a flexible, 100% UVA and UVB blocking, non-toxic material.

5. A sun shield comprising:

a cap;

a transparent shield of a material suitable for blocking ultraviolet radiation, said transparent shield having an edge fastened to said cap such that said transparent shield extends downwardly from said cap, said transparent shield having an outer peripheral edge extending therearound, said transparent shield having a convexed center extending outwardly transverse from said edge of said cap, said transparent shield having a strip of adhesive backed hook-and-loop material fastened along a top edge of said transparent shield, said cap having a strip of adhesive backed hook-and-loop material fastened along a lower edge of said cap, said hook-and-loop material of said cap engaging said hook-and-loop material of said transparent shield, said adhesive backed hook-and-loop material of said transparent shield fastened to an outer surface of said transparent shield and facing upwardly therefrom, said adhesive backed hook-and-loop material of said cap fastened along an inner edge of said cap and facing downwardly therefrom; and a binding material affixed to said transparent shield so as to entirely cover said outer peripheral edge of said transparent shield.

* * * * *